United States Patent [19]

Wallman et al.

[11] 4,392,942

[45] Jul. 12, 1983

[54] MODIFIED STAGED TURBULENT BED PROCESS FOR RETORTING CARBON CONTAINING SOLIDS

[75] Inventors: P. Henrik Wallman, Berkeley; Byron G. Spars, Mill Valley, both of Calif.

[73] Assignee: Chevron Research Company, San Francisco, Calif.

[21] Appl. No.: 271,297

[22] Filed: Jun. 8, 1981

Related U.S. Application Data

[63] Continuation-in-part of Ser. No. 187,858, Sep. 17, 1980.

[51] Int. Cl.[3] ..... C10G 1/00

[52] U.S. Cl. ..... 208/11 R; 208/8 R

[58] Field of Search ..... 208/11 R, 8 R

[56] References Cited

U.S. PATENT DOCUMENTS

| | | | |
|---|---|---|---|
| 3,093,571 | 6/1963 | Fish | 208/11 R |
| 3,976,558 | 8/1976 | Hall | 208/11 R |
| 4,087,347 | 5/1978 | Langlois | 208/11 R |
| 4,105,502 | 8/1978 | Choi | 208/8 R X |
| 4,199,432 | 4/1980 | Tamm et al. | 208/8 R |
| 4,230,557 | 10/1980 | Bertelsen et al. | 208/8 R |

*Primary Examiner*—Delbert E. Gantz

*Attorney, Agent, or Firm*—D. A. Newell; S. R. LaPaglia; J. W. Ambrosius

[57] ABSTRACT

A process for retorting a carbon containing solid, especially oil shale, comprises passing heat transfer particles and raw particles of carbon containing solid downwardly through a fluidized retort zone containing a plurality of baffles to prevent gross vertical backmixing. The heated solid particles and heat transfer particles are then passed to a moving packed bed retort to pyrolyze the carbon containing solid particles.

13 Claims, 2 Drawing Figures

MODIFIED STAGED TURBULENT BED PROCESS FOR RETORTING CARBON CONTAINING SOLIDS

CROSS-REFERENCE TO RELATED APPLICATION

This application is a continuation-in-part of U.S. application Ser. No. 187,858, filed Sept. 17, 1980. The test of said parent application is herein incorporated by reference.

BACKGROUND OF THE INVENTION

1. Field of the Invention

The present invention relates to a process for retorting a carbon containing solid such as oil shale. More particularly, the process pertains to a combination staged turbulent bed/moving packed bed retort.

2. Description of the Prior Art

Certain naturally-occurring materials such as oil shale and tar sands, including diatomite, contain a carbonaceous fraction which during retorting releases an oil useful in petroleum processing.

In a staged turbulent bed retort, crushed raw oil shale particles (or other carbon containing solids) and particulate heat transfer materials at an elevated temperature, such as hot burned shale, are introduced into an upper portion of a vertical retort and pass downwardly therethrough. A strippling gas, preferably steam, is introduced into a lower portion of the retort and passes upwardly through the vessel in countercurrent flow to the downwardly moving solids.

The maximum particle size for the solids introduced is preferably maintained at or below 2½ mesh. Tyler standard sieve size. Oil shale sizes in this range are easily produced by conventional means such as combinations of cage mills, jaw or gyratory crushers. The crushing operations may be conducted to produce a maximum particle size, but little or no control is effected over the smaller particle sizes produced, and thus a broad particle size distribution is encountered.

With such broad particle size distributions a portion of the solids is fluidized and the remaining solids are either entrained and swept out of the system or pass to the bottom of the retort. Stable fluidization conditions are maintained by substantially limiting gross vertical backmixing and slugging of the solids through the use of baffles disposed throughout the retort. Typical baffles suitable for use include perforated plates or grille structures horizontally disposed in the retort vessel.

A detailed description of the staged turbulent bed retort may be found in U.S. Pat. No. 4,199,432, issued to Paul W. Tamm and Gordon Langlois on Apr. 22, 1978, which patent is incorporated herein by reference.

Although the staged turbulent bed retort is capable of handling large mass flow rates, the retort vessel must be sufficiently high to provide a residence time of approximately 2 to 10 minutes to allow the kerogen pyrolysis reaction to occur. In contrast to the relatively long residence time required for the reaction, heat transfer between heat carrier particles and raw shale particles requires only a residence time of 15 to 50 seconds for the largest particles. Although the staged turbulent bed is ideal for heat transfer purposes, its vigorous mixing action results in attrition of the retorted shale particles and subsequent carry over of fines from the retort vessel by the vapor point.

Thus, it becomes desirable to reduce the residence time of particles in the staged turbulent bed to a minimum, namely that required for heat transfer, and provide residence time for the kerogen pyrolysis reaction in a less turbulent environment.

SUMMARY OF THE INVENTION

In its broadest aspect the invention involves a continuous process for retorting a particulate carbon containing solid which comprises:

- passing heat transfer particles at an elevated temperature and raw carbon containing solid downwardly through a first retort zone;
- passing a first stripping gas upwardly through said first retort zone;
- maintaining the size of the heat transfer particles and the size of the particles of raw carbon containing solid such that a portion of the raw carbon containing solid are fluidized, and a portion of the particles of raw carbon containing solid and at least a portion of the heat transfer particles are nonfluidized in said first retort zone;
- substantially limiting gross vertical backmixing and slugging of the particles within the first retort zone by passing said downwardly moving particles through a plurality of baffles in said first retort zone;
- providing sufficient residence time in the first retort zone for the heavier nonfluidized particles of carbon containing solid to be substantially heated to retorting temperatures;
- passing said heat transfer particles and said heated carbon containing solid particles from the bottom of said first retort zone to a second, non-fluidized, retort zone;
- maintaining the particles of carbon containing solid in said second retort zone for a residence time sufficient to provide substantially complete pyrolysis of said carbon containing solids;
- passing a second stripping gas through the second retort zone to strip hydrocarbonaceous vapors from the retorted solids;
- withdrawing exhausted first stripping gas from the top of said first retort zone;
- withdrawing exhausted second stripping gas and hydrocarbonaceous vapors from said second retort zone; and
- withdrawing heat transfer particles and retorted solids from said second retort zone.

More specifically, the present invention is a continuous process for retorting raw oil shale which comprises:

- passing heat transfer particles at an elevated temperature and raw shale particles downwardly through a first retort zone;
- passing a first stripping fluidization gas upwardly through said first retort zone;
- maintaining the size of the heat transfer particles and the size of the raw shale particles such that a portion of the raw shale particles and preferably a portion of the heat transfer particles are fluidized and the remainder of said particles are nonfluidized in said first retort zone;
- substantially limiting gross vertical backmixing and slugging of the particles within the first retort zone by passing said downwardly moving particles through a plurality of baffles in said first retort zone;

providing sufficient residence time in the first retort zone for the heavier nonfluidized shale particles to be substantially heated to retorting temperatures;

passing the particulate heat transfer particles and said heated shale particles from the bottom of said first retort zone to a second, non-fluidized, retort zone;

maintaining the shale particles in said non-fluidized retort zone for a residence time sufficient to provide substantially complete pyrolysis of said shale particles to retorted shale and hydrocarbonaceous vapors;

passing a second stripping gas through the second retort zone to strip hydrocarbonaceous vapors from the retorted shale;

withdrawing exhausted first stripping gas from the top of said first retort zone;

withdrawing exhausted second stripping gas and hydrocarbonaceous vapors from said second retort zone;

withdrawing the heat transfer particles and the retorted shale from the second retort zone.

Preferably, the withdrawn exhausted second stripping gas and admixed hydrocarbonaceous vapors are passed upwardly through the first retort zone as the first stripping gas.

Preferably, the baffles used for limiting gross vertical backmixing and slugging of the particles within the first retort zone comprise perforated plates or grille structures which are horizontally disposed throughout said zone at spacings of 30 to 100 cm. The baffles should have an open area of 30 to 90% to minimize bed slugging and gas channeling. Substantially all of the heat carrier particles can be non-fluidized, if desired.

The residence time for the heavier nonfluidized shale particles should be approximately 15 to 50 seconds in the first retort zone. The stripping gas and first stripping gas may comprise steam, recycled gas, or any inert gas, but are preferably devoid of any oxidizing gas. The invention may further comprise burning the previously retorted shale effluent from the retort in a separate combustion zone and returning at least a portion of the spent shale as hot heat transfer materials to the retort.

DETAILED DESCRIPTION OF THE PREFERRED EMBODIMENTS

As used herein, the term "staged turbulent bed retort" refers to retorts such as are described in U.S. Pat. No. 4,199,432, issued Apr. 22, 1980, incorporated herein by reference.

As used herein, the term "oil shale" refers to fine grained sedimentary inorganic material which is predominantly clay, carbonates and silicates in conjunction with organic matter composed of carbon, hydrogen, sulfur, oxygen, and nitrogen, called "kerogen".

The term "retorted shale", as used herein, refers to oil shale from which essentially all of the volatizable hydrocarbons have been removed, but which may still contain carbonaceous residue.

The term "burned shale", as used herein, refers to retorted shale from which a substantial portion of the carbonaceous residue has been removed, for example by combustion in a combustion zone.

The terms "condensed", "noncondensable", "normally gaseous", or "normally liquid" are relative to the conditions of the subject material at a temperature of 25° C. and a pressure of 1 atmosphere.

Particle size, unless otherwise indicated, is measured with respect to Tyler standard sieve sizes.

Figure 1:
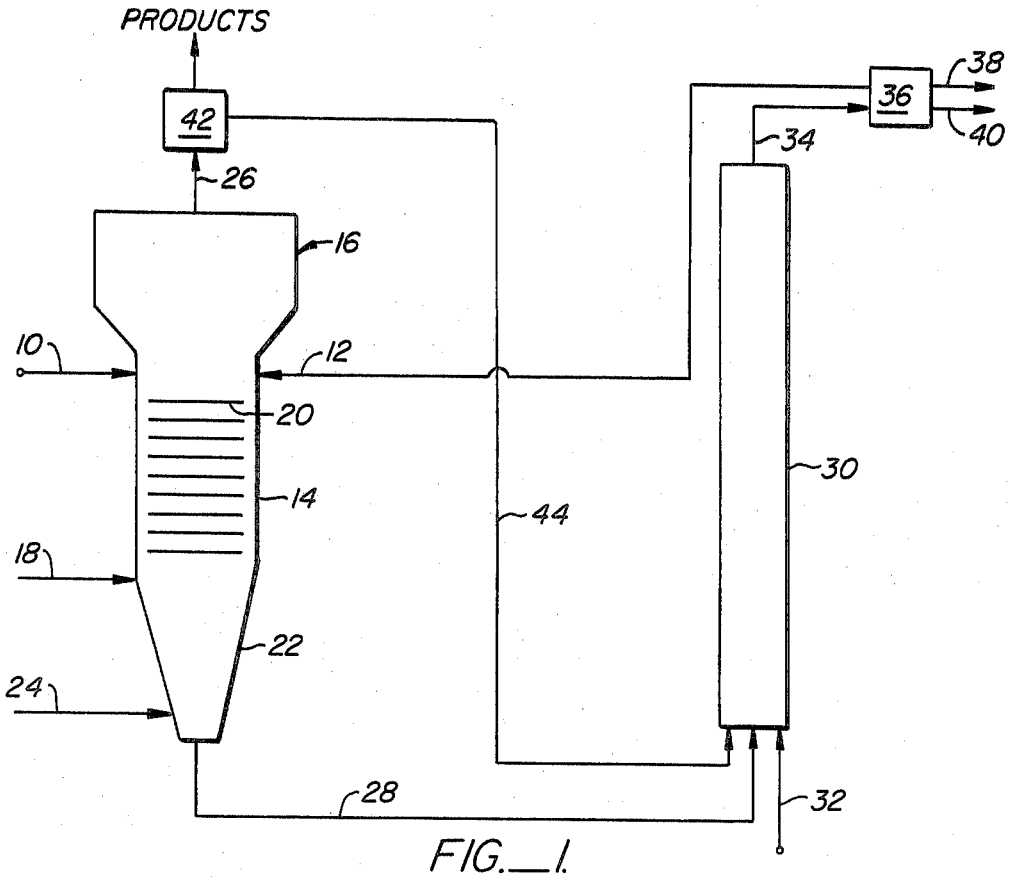
FIg. 1 is a schematic flow diagram of an embodiment of apparatus and flow paths suitable for carrying out the process of the present invention where the turbulent bed and the moving bed are contained within the same vessel.

Referring now to FIG. 1, raw shale particles and hot burned shale particles are introduced through lines 10 and 12, respectively, into the first retort zone 14 of a vertically elongated retort, generally characterized by reference numeral 16, and pass downwardly therethrough. A first stripping gas is introduced via line 18 to an intermediate portion of the elongated retort and is passed upwardly through the first retort zone fluidizing a portion of the solids. A plurality of baffles 20 are horizontally disposed in the first retort zone to stabilize the bed and substantially limit gross vertical backmixing and slugging. The solids pass from the first retort zone downwardly to a second retort zone 22 as a moving bed of solids. A second stripping gas is introduced at the bottom of the bed through line 24 to strip hydrocarbonaceous materials retorted from the shale in the second retort zone. The stripping gas and evolved hydrocarbonaceous vapors along with any entrained fines pass upwardly through the retort and are removed with the first stripping gas from the top of the retort via line 26. Effluent retorted shale and burned shale heat carrier are removed from the bottom of the retort through line 28.

Figure 2:
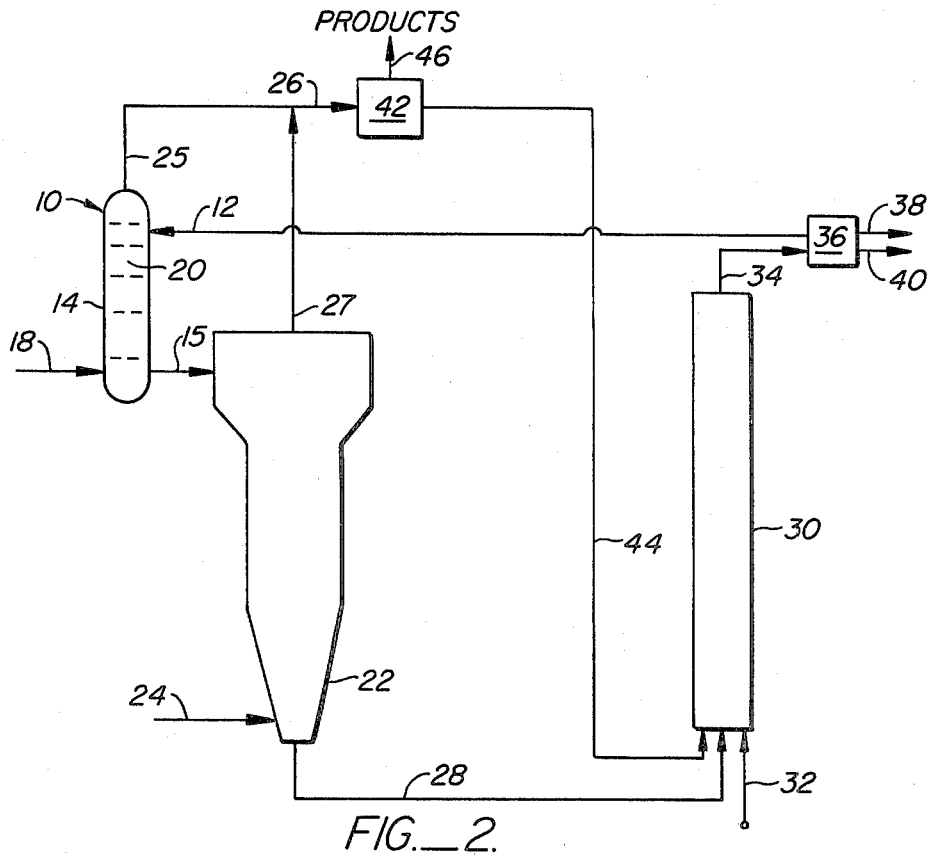
FIG. 2 is a schematic flow diagram of an embodiment of apparatus and flow paths suitable for carrying out the process of the present invention where the turbulent bed and the moving bed are separately contained.

An alternative arrangement is shown in FIG. 2. There the first retort zone 14 is separated from the second retort zone 22 by a seal leg 15. The gas for partially fluidizing the first retort zone is introduced through line 18 at the bottom of the first retort zone. The gas for stripping is introduced at the bottom of the second retort zone through line 24 and is withdrawn at the top of this zone by line 27. The exhausted gas from the first retort zone and the exhausted stripping gas are joined and further processed to remove hydrocarbonaceous vapors.

It should be noted that in FIG. 1 the stripping gas and evolved hydrocarbonaceous gases act as a supplemental first stripping gas for the solids in the first retort zone. It is possible that if an exceptionally rich batch of shale was processed as shown in FIG. 1, no first stripping gas whatever would need to be introduced via line 18. In the arrangement of FIG. 2, no matter how rich the particular batch of shale was, the same constant amount of first stripping gas would be introduced into the first retort zone through line 18. Since some amount of hydrocarbonaceous gas evolution is unavoidable with the process of the first retort zone, the first stripping gas should be withdrawn and the hydrocarbonaceous materials collected.

The effluent solids from the retort pass via line 28 to a combustor 30. Air is introduced to the combustor through line 32 and provides oxygen to burn residual carbon on the retorted shale. The carbon combustion heats the previously retorted shale, which is then removed with the flue gas from an upper portion of the combustor through line 34 and passes through a separation zone 36. A portion of a heated burned shale, preferably above 200 mesh is recycled through line 12 as heat transfer particles to provide process heat to retort. Hot flue gas and the remaining solids pass from separation zone 36 through lines 38 and 40 respectively.

The time required for heating the raw shale particles to retort temperature depends on the raw shale particle size. The time required for the pyrolysis reaction depends on the temperature. In general, the time required for heating is considerably less than the time required for pyrolysis. For a 5 mesh particle, the average time required to elevate the particle from 20° C. to 500° C. is about 15 seconds in a staged turbulent bed retort, whereas the reaction time for pyrolysis is approximately 2 to 10 minutes for pyrolysis temperatures of 525°–460° C., and approximately 3 minutes at 500° C. A 2½ mesh particle requires a heat-up time of 50 seconds, and approximately the same pyrolysis time as the 5 mesh particle.

The maximum particle size for raw shale or heat carrier introduced into a regular staged turbulent bed, wherein both heating and pyrolysis are accomplished, is normally at or below 2½ mesh Tyler standard sieve size. Particles larger than 2½ mesh produce highly turbulent beds with unacceptably high levels of attrition. Since the turbulent bed of the present invention, the first retort zone, is primarily to provide a zone for heat transfer, the residence time of particles need be only 15–50 seconds and a greater degree of turbulence can be tolerated. To fully pyrolyze the shale requires 2–10 minutes at 525°–460° C. The longer residence time required for the completion of the kerogen pyrolysis reaction is provided by a moving packed bed, i.e., the second retort zone.

The separation of the heat transfer zone from the pyrolysis zone reduces attrition of the shale particles in the retort. Much of the mechanical strength of oil shale is provided by the kerogen. For example, Colorado oil shale has been found to lose much of its mechanical strength when the kerogen, which acts as a binding material, is removed through the pyrolysis reaction. Here the pyrolysis takes place primarily in the packed moving bed, minimizing attrition of the heated particles and entrainment of fines. Preferably less than 70% of the pyrolysis, and more preferably less than 50% of the pyrolysis occurs in the turbulent bed retort.

The temperature of the burned shale introduced to the retort via line 12 will normally be in the range of 600° to 820° C., depending upon the selected operating ratio of heat transfer material to shale. The raw shale may be introduced at ambient temperatures or preheated, if desired, to reduce the heat transfer required between fresh shale and the heat carrier. The temperature at the top of the retort should be maintained within a broad range, 450° C. to 540° C., and is preferably maintained in the range of 480° C. to 500° C.

The weight ratio of burned shale heat carrier to fresh shale may be varied from approximately 1.5:1 to 8:1 with a preferred weight ratio in the range of 2.0:1 to 3:1. It has been observed that some loss in product yield occurs at the higher weight ratios of burned shale to fresh shale and it is believed that the cause for such loss is due to increased adsorption of the retorted hydrocarbonaceous vapor by larger quantities of burned shale. Furthermore, attrition of the burned shale, which is a natural consequence of retorting and combustion of the shale, occurs to such an extent that high recycle ratios cannot be achieved with burned shale alone. If it is desired to operate at the higher weight ratios of heat carrier to fresh shale, sand may be substituted as part or all of the heat carrier.

The mass flow rate of fresh shale through the retort scheme of FIG. 1 should be maintained between 5000 kg/hr.m$^2$ and 30,000 kg/hr.m$^2$ and preferably between 10,000 kg/hr.m$^2$ and 20,000 kg/hr.m$^2$. Thus, in accordance with the broader recycle heat carrier weight ratios stated above, the total solids mass rate will range from approximately 12,500 kg/hr.m$^2$ to 250,000 kg/hr.m$^2$.

In the scheme of FIG. 2, the preferable mass flow rate of fresh shale through the staged-turbulent-bed section is 40,000–80,000 kg/hr. m$^2$. The packed section is preferably expanded so as to give a fresh shale mass flow rate of 5,000–20,000 kg/hr.m$^2$. The latter rate is kept low because otherwise evolving hydrocarbons produce high gas velocities.

A first stripping gas is preferably introduced, via line 18, into the bottom of the first retort zone and passes upwardly through the vessel, countercurrent to the downwardly moving shale. The flow rate of the first stripping gas should be maintained to produce a superficial gas velocity in the first retort zone of the vessel in the range of approximately 30 cm per second to 150 cm per second, with a preferred superficial velocity in the range of 30 cm per second to 90 cm per second. The first stripping gas may be comprised of steam, recycle product gas, hydrogen or any inert gas. It is particularly preferred, however, that the stripping gas selected be essentially free of molecular oxygen to prevent product decomposition within the retort. It should also be noted that the addition of first stripping gas is not required in those cases wherein sufficient hydrocarbonaceous vapors are evolved from the raw shale in the lower section of the retort, and, when combined with the second stripping gas added to the lower section of the retort, provide sufficient quantities of gas to partially fluidize the shale passing downwardly through the staged turbulent bed section. It should also be noted that in the scheme of FIG. 2 the amount of first stripping gas provided is always constant since none of the second stripping gas or hydrocarbonaceous vapors evolved in the second retort zone pass through the first retort zone. When the scheme of FIG. 1 is used, the amount of first stripping gas can be varied depending on the richness of the shale, so that the total velocity of the gas in the first retort zone is always constant.

The first stripping gas will fluidize those particles of the raw shale and preferably also heat carrier having a minimum fluidization velocity less than the velocity of the first stripping gas. Those particles having a fluidization velocity greater than the gas velocity will pass downwardly through the retort, generally at a faster rate than the fluidized particles. An important feature of the staged turbulent bed retort lies in limiting maximum bubble size and the vertical backmixing of the downwardly moving shale and heat carrier to produce stable, substantially plug flow conditions through the retort. The means for limiting backmixing and for limiting the maximum bubble size may be generally described as baffles. The term "baffles" as used herein includes barriers, dispersers or flow redistributors, such as spaced horizontal perforated plates, grille bars, screens, packing, or other suitable internals.

The partially fluidized solids generally proceed down the first retort zone of the present invention as a moving columnar body. Without internals, a stable moving bed cannot be achieved with such a broad particle size solids mixture. The means for limiting backmixing significantly affects the motion of the nonfluidized particles and substantially increases the residence time of said particles in a regular staged turbulent bed retort. The average velocity of the falling nonfluidized particles, which determines said particles' residence time, is substantially decreased by momentum transfer to the fluidized solids. This increased residence time thereby permits the larger particles be heated in a relatively shallow staged turbulent bed.

The baffle system selected depends on the type of bed that is desired. Typically, a relatively coarse bed, with accompanying high coarse particle residence times, is desired. Such a bed is created by the use of baffles with a relatively small open area with relatively large vertical separation, for example an open area of 30–70% the total cross sectional area of the baffles and a vertical spacing of 30 to 100 cm. If a bed highly enriched in fines is desired, baffles with a relatively large open area and a small vertical spacing are used, for example 70–90% open area with a spacing of less than 30 cm. A fines enriched bed is smoother in operation and results in less attrition than a coarser bed, however, in a fine bed the coarse particles tend to have a low residence time and a high downward velocity through the bed. Preferably, the baffle system selected will provide at least two perfectly mixed stages. A more detailed discussion of staged-turbulent-bed-baffle systems can be found in U.S. application Ser. No. 145,290 filed Apr. 30, 1980, which is incorporated herein by reference.

The solids pass from the first retort zone 14 into the second retort zone 22 and are preferably maintained as a downwardly moving packed bed of solids. The second retort zone should be of sufficient volume to provide a residence time that will assure substantially complete pyrolysis of the kerogen in the raw shale. Preferably, a residence time of approximately 2 to 10 minutes will be provided.

A second stripping gas, preferably steam, is introduced to the bottom of the lower portion of the retort through line 24 and flows upwardly through the retort, stripping the downwardly moving solids of evolving hydrocarbonaceous vapors. The gas should be introduced so as to maintain a rate of 5 to 20 cm per second, more preferably, 10 cm per second for FIG. 1. A product effluent stream, comprising hydrocarbonaceous material admixed with the first stripping gas and second stripping gas, is removed from the upper portion of the first retort zone by conventional means through line 26 and passed to separation zone 42. In the scheme of FIG. 2, the first stripping gas is withdrawn through line 25 and the stripping gas and contained hydrocarbons are removed through line 27. Since it is unavoidable that the first stripping gas will have some hydrocarbonaceous component, line 25 is joined with line 27 to form line 26 leading to further processing. Since the product effluent stream will normally contain some entrained fines, it is preferred that said fines be separated from the remainder of the stream by separator 42 prior to further processing. This separation may be effected by any suitable or conventional means, such as cyclones, pebble beds and/or electrostatic precipitators. Preferably, the fines which are separated from the product effluent stream pass via line 44 to a combustor, generally characterized by reference numeral 30. Product effluent free of fines passes from the separation zone via line 46. At this juncture, conventional and well-known processing methods may be used to recover the hydrocarbon gas and liquid products from the effluent stream.

In the embodiments of FIGS. 1 and 2 the retorted shale along with the burned shale serving as heat carrier is removed from the lower portion of the retort via line 28 by conventional means at the retort temperature. The retorted shale will have a residual carbon content of approximately 2 to 4 weight percent, which represents a valuable source of energy that may be used to the advantage in the process. From line 28 the retorted shale and burned shale are fed to a lower portion of combustor 30. While combustor 30 may be of conventional design, it is preferred that it be a dilute phase lift combustor. Air is injected into the lower portion of the combustor via line 32 and the residual carbon on the retorted shale is at least partially burned. The carbon combustion heats the retorted shale to a temperature in the range of 600° C. to 820° C. and the hot shale and flue gas are removed from the upper portion of the combustor via line 34 and passed to a separation zone 36. A portion of the hot shale is recycled via line 12 to provide heat for the retort. Preferably, the recycled shale is classified to remove substantially all of the minus 200 mesh shale prior to introduction to the retort to minimize entrained fines carryover in the effluent product vapor. Hot flue gases are removed from the separation zone via line 38 and waste burned solids are passed through the zone via line 40.

What is claimed is:

1. A continuous process for retorting oil shale which comprises:

passing heat transfer particles at an elevated temperature and raw shale particles downwardly through a first retort zone;

passing a first stripping gas upwardly through said first retort zone;

maintaining the size of the heat transfer particles and the size of the raw shale particles such that a portion of the raw shale particles is fluidized, and a portion of the raw shale particles and at least a portion of the heat transfer particles are nonfluidized in said first retort zone;

substantially limiting gross vertical backmixing and slugging of the particles within the first retort zone by passing said downwardly moving particles through a plurality of baffles in said first retort zone;

providing sufficient residence time in the first retort zone for the heavier nonfluidized shale particles to be substantially heated to retorting temperatures;

passing said heat transfer particles and said heated shale particles from the bottom of said first retort zone to a second, non-fluidized, retort zone;

maintaining the shale particles in said second retort zone for a residence time sufficient to provide substantially complete pyrolysis of said shale particles;

passing a second stripping gas through the second retort zone to strip hydrocarbonaceous vapors from the retorted shale;

withdrawing exhausted first stripping gas from the top of said first retort zone;

withdrawing exhausted second stripping gas and hydrocarbonaceous vapors from said second retort zone; and withdrawing heat transfer particles and retorted shale from said second retort zone.

2. A process as recited in claim 1, wherein the withdrawn exhausted second stripping gas and hydrocarbonacous vapors from said second retort zone are passed upwardly through said first retort zone as first stripping gas.

3. A process as recited in claim 1 or 2, wherein the heat transfer particles are burned shale particles.

4. A process as recited in claim 1 or 2, wherein said first stripping gas and said second stripping gas comprise steam.

5. A process as recited in claim 1 or 2, wherein the heavier nonfluidized shale particles have a residence time in the range of 15 to 50 seconds in the first retort zone.

6. A process as recited in claim 1 or 2, wherein said baffles have an open area of 30 to 70% of the total cross-sectional area of said baffles, and said baffles are horizontally disposed at vertical spacings of approximately 30 to 100 cm in the first retort zone.

7. A process as recited in claim 1 or 2, further comprising:

passing a portion of effluent solids, including particles containing residual carbonaceous material, from said second retort zone into a combustion zone separate from said retort zones;

contacting said effluent solids in said combustion zone with an oxygen-containing gas under conditions which result in burning at least a portion of said residual carbonaceous material, thereby heating said effluent solids;

withdrawing at least a portion of said heated effluent solids from said combustion zone; and introducing said portion of said heated effluent solids into said first retort zone as said heat transfer particles.

8. A process as recited in claim 7, wherein substantially all of the heated effluent solids introduced to said retort are larger than 200 mesh in size.

9. A process as recited in claim 1 or 2, wherein the equivalent of at least 2 perfectly mixed serial stages is provided in the first retort zone.

10. A process as recited in claim 1 or 2, wherein the size of said heat transfer particles is maintained such that a portion of the heat transfer particles is fluidized in said first retort zone.

11. A process as recited in claim 10, wherein the heat transfer particles are burned shale particles.

12. A process as recited in claim 10, wherein said first stripping gas and said second stripping gas comprise steam.

13. A continuous process for retorting a particulate carbon containing solid which comprises:

passing heat transfer particles at an elevated temperature and raw carbon containing solid downwardly through a first retort zone;

passing a first stripping gas upwardly through said first retort zone;

maintaining the size of the heat transfer particles and the size of the particles of raw carbon containing solid such that a portion of the raw carbon containing solid are fluidized, and a portion of the particles of raw carbon containing solid and at least a portion of the heat transfer particles are nonfluidized in said first retort zone;

substantially limiting gross vertical backmixing and slugging of the particles within the first retort zone by passing said downwardly moving particles through a plurality of baffles in said first retort zone;

providing sufficient residence time in the first retort zone for the heavier nonfluidized particles of carbon containing solid to be substantially heated to retorting temperatures;

passing said heat transfer particles and said heated carbon containing solid particles from the bottom of said first retort zone to a second, non-fluidized, retort zone;

maintaining the particles of carbon containing solid in said second retort zone for a residence time sufficient to provide substantially complete pyrolysis of said carbon containing solids;

passing a second stripping gas through the second retort zone to strip hydrocarbonaceous vapors from the retorted solids;

withdrawing exhausted first stripping gas from the top of said first retort zone;

withdrawing exhausted second stripping gas and hydrocarbonaceous vapors from said second retort zone; and withdrawing heat transfer particles and retorted solids from said second retort zone.

* * * * *